US009069311B2

(12) United States Patent
Ohba

(10) Patent No.: US 9,069,311 B2
(45) Date of Patent: Jun. 30, 2015

(54) IMAGE FORMING APPARATUS CONTROLLING FIXING TEMPERATURE

(71) Applicant: KYOCERA Document Solutions Inc., Osaka (JP)

(72) Inventor: Tadashi Ohba, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 122 days.

(21) Appl. No.: 13/862,649

(22) Filed: Apr. 15, 2013

(65) Prior Publication Data

US 2013/0287423 A1 Oct. 31, 2013

(30) Foreign Application Priority Data

Apr. 25, 2012 (JP) ..... 2012-099849
Jan. 31, 2013 (JP) ..... 2013-017718

(51) Int. Cl.
*G03G 15/20* (2006.01)
*G03G 15/00* (2006.01)
*G03G 15/16* (2006.01)

(52) U.S. Cl.
CPC ..... *G03G 15/2078* (2013.01); *G03G 15/2039* (2013.01); *G03G 15/5025* (2013.01); *G03G 15/1675* (2013.01)

(58) Field of Classification Search
CPC ..... G03G 15/2039; G03G 15/2078
USPC ..... 399/45, 67, 69
See application file for complete search history.

(56) References Cited

U.S. PATENT DOCUMENTS 8,433,212 B2 * 4/2013 Ono ..... 399/69

FOREIGN PATENT DOCUMENTS

JP 2000-214672 A 8/2000

* cited by examiner

*Primary Examiner* — William J Royer
(74) *Attorney, Agent, or Firm* — Knobbe, Martens, Olson & Bear LLP

(57) ABSTRACT

An image forming apparatus includes a toner image forming section, a fixing section, and a control section. The toner image forming section forms a toner image based on image data for printing on printing paper. The fixing section fixes the toner image on the printing paper through thermocompression. The control section controls a toner image forming operation by the toner image forming section and a fixing operation by the fixing section. The control section calculates a size parameter associated with a size of a uniform density region included in the toner image based on the image data for the printing and controls a fixing temperature of the fixing section according to a calculation result.

12 Claims, 14 Drawing Sheets

Fig.7

| AREA Q ( $mm^2$ or NUMBER OF DOTS) OF UNIFORM DENSITY REGION | Q0 | Q1 | Q2 | Q3 | Q4 | Q5 |
|---|---|---|---|---|---|---|
| FIXING TEMPERATURE SETTING VALUE T (°C) | T0 | T1 | T2 | T3 | T4 | T5 |

※ $\begin{cases} Q0<Q1<Q2<Q3<Q4<Q5 \\ T0<T1<T2<T3<T4<T5 \end{cases}$

Fig.9

| AREA RATIO QR (%) OF UNIFORM DENSITY REGION | QR0 | QR1 | QR2 | QR3 | QR4 | QR5 |
|---|---|---|---|---|---|---|
| FIXING TEMPERATURE SETTING VALUE T (°C) | T0 | T1 | T2 | T3 | T4 | T5 |

※ $\begin{cases} QR0 < QR1 < QR2 < QR3 < QR4 < QR5 \\ T0 < T1 < T2 < T3 < T4 < T5 \end{cases}$

Fig. 11

| DATA AMOUNT D (%) OF UNIFORM DENSITY REGION | D0 | D1 | D2 | D3 | D4 | D5 |
|---|---|---|---|---|---|---|
| FIXING TEMPERATURE SETTING VALUE T(°C) | T0 | T1 | T2 | T3 | T4 | T5 |

※ $\begin{cases} D0<D1<D2<D3<D4<D5 \\ T0<T1<T2<T3<T4<T5 \end{cases}$

Fig. 13A

| DATA AMOUNT D (%) OF UNIFORM DENSITY REGION | D0 | D1 | D2 | D3 | D4 | D5 |
|---|---|---|---|---|---|---|
| FIXING TEMPERATURE SETTING VALUE T(°C) | T0 | T1 | T2 | T3 | T4 | T5 |

※ $\begin{cases} D0<D1<D2<D3<D4<D5 \\ T0<T1<T2<T3<T4<T5 \end{cases}$

Fig. 13B

| DATA AMOUNT D (%) OF UNIFORM DENSITY REGION | D0 | D1 | D2 | D3 | D4 | D5 |
|---|---|---|---|---|---|---|
| TRANSFER CURRENT (μA) | J0 | J1 | J2 | J3 | J4 | J5 |

※ $\begin{cases} D0<D1<D2<D3<D4<D5 \\ J0<J1<J2<J3<J4<J5 \end{cases}$

IMAGE FORMING APPARATUS CONTROLLING FIXING TEMPERATURE

INCORPORATION BY REFERENCE

This application claims priority to Japanese Patent Application No. 2012-99849 filed on Apr. 25, 2012 and Japanese Patent Application No. 2013-17718 filed on Jan. 31, 2013, the entire contents of which are incorporated by reference herein.

BACKGROUND

The present disclosure relates to an image forming apparatus such as a printer, a copy machine, or a multifunction peripheral.

Technology for constantly maintaining a uniform toner density within a developing device and implementing the stabilization of image quality by calculating a coverage rate of an image from input image information and controlling an amount of toner supply to the developing device according to the calculation result of the coverage rate in an image forming apparatus such as a printer, a copy machine, or a multifunction peripheral is disclosed.

If there are many uniform density regions such as solid regions or half-tone regions in a toner image formed on (transferred onto) printing paper even when the coverage rate of the image is low in the image forming apparatus of the above-described electrographic method, uneven brightness is likely to occur in a finished image on the printing paper after a fixing process due to variation occurred in melting of toner in the uniform density regions and other regions in the fixing process on the printing paper at a given temperature.

SUMMARY

As an aspect of the present disclosure, technology for enabling a high-quality image to be obtained by suppressing the occurrence of the above-described uneven brightness is proposed.

That is, an image forming apparatus in accordance with an aspect of the present disclosure includes a toner image forming section, a fixing section, and a control section.

The toner image forming section forms a toner image based on image data for printing on printing paper.

The fixing section fixes the toner image on the printing paper through thermocompression.

The control section controls a toner image forming operation by the toner image forming section and a fixing operation by the fixing section. The control section calculates a size parameter associated with a size of a uniform density region included in the toner image based on the image data for the printing and controls a fixing temperature of the fixing section according to a calculation result.

BRIEF DESCRIPTION OF THE DRAWINGS

FIG. 7 is a diagram illustrating table data representing a preset correspondence relationship between an area Q of a uniform density region and a fixing temperature setting value T;

FIG. 9 is a diagram illustrating table data representing a preset correspondence relationship between an area ratio QR of a uniform density region and a fixing temperature setting value T;

FIG. 11 is a diagram illustrating table data representing a preset correspondence relationship between a data amount D of a uniform density region and a fixing temperature setting value T;

FIG. 13A is a diagram illustrating table data representing a preset correspondence relationship between a data amount D of a uniform density region and a fixing temperature setting value T.

FIG. 13B is a diagram illustrating table data representing a preset correspondence relationship between a data amount D of a uniform density region and a primary transfer current value J; and

DETAILED DESCRIPTION

Hereinafter, an image forming apparatus in accordance with an embodiment as an aspect of the present disclosure will be described with reference to the drawings. Also, hereinafter, an example of a multifunction peripheral of an electrographic method having functions of a copy machine, a printer, a facsimile, and the like will be described as an image forming apparatus in accordance with the present disclosure.

Figure 1:
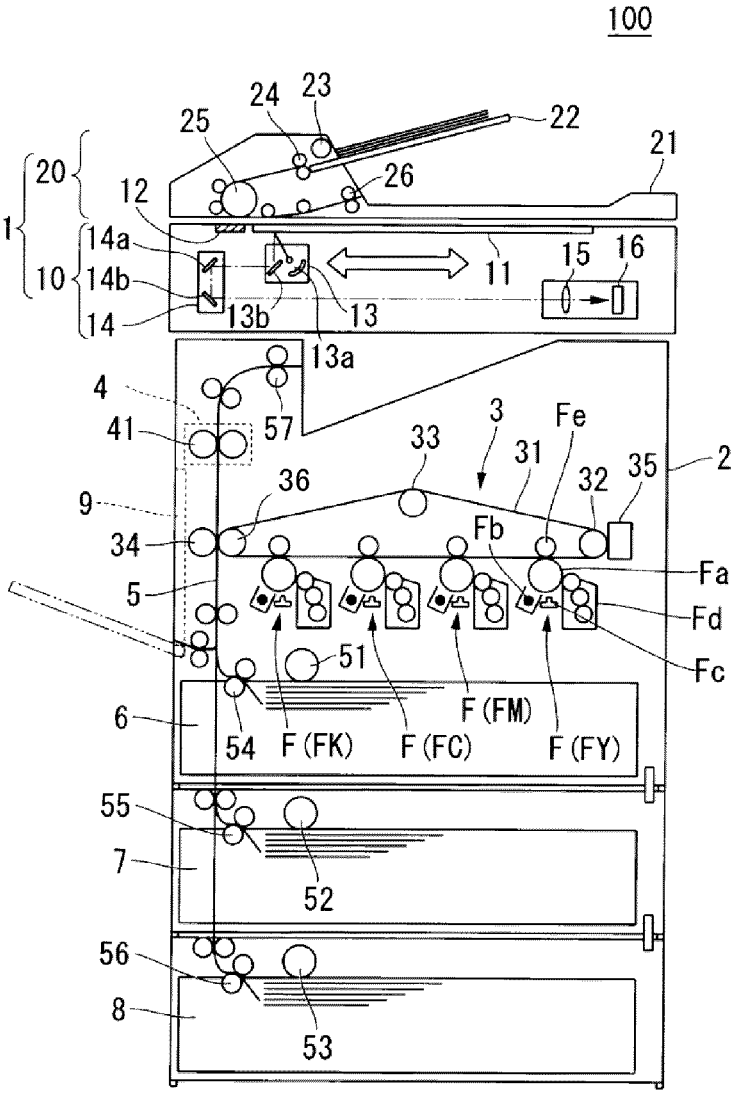
FIG. 1 is a front perspective view illustrating a configuration of main parts of a multifunction peripheral in accordance with an embodiment.

FIG. 1 is a front perspective view illustrating a configuration of main parts of a multifunction peripheral 100 in accordance with this embodiment. As illustrated in FIG. 1, the multifunction peripheral 100 includes a document scanning device 1 configured to scan a document and generate image data of the document (hereinafter referred to as document image data) and a main body 2 configured to form an image on printing paper based on the document image data obtained from the document scanning device 1 or image data received from an external device (hereinafter referred to as reception image data) via a communication link.

The document scanning device 1 includes a scanner 10 and an auto document feeder (ADF) 20. The scanner 10 scans a document set on platen glass 11 or a document automatically fed by the ADF 20. The scanner 10 includes the platen glass 11, a white reference plate 12, a full rate carriage 13, a half rate carriage 14, a condensing lens 15, and a charge-coupled device (CCD) sensor 16.

The platen glass 11 is a glass plate on which documents to be scanned are set one by one. The white reference plate 12 is a white plate used to acquire white reference data for shading correction. The full rate carriage 13 is provided below the platen glass 11 so as to be reciprocally movable in a left/right direction (scanning direction) along the platen glass 11 through a carriage transport mechanism (not illustrated). The full rate carriage 13 includes a lamp 13*a* configured to emit illumination light obliquely and upward and a mirror 13*b* configured to reflect reflection light of the illumination light toward the half rate carriage 14 in a built-in type as will be described later.

Like the full rate carriage 13, the half rate carriage 14 is provided so as to be reciprocally movable in the left/right direction along the platen glass 11 through the carriage transport mechanism (not illustrated). The half rate carriage 14 includes a mirror 14*a* configured to reflect light incident from the mirror 13*b* of the full rate carriage 13 downward, and a mirror 14*b* configured to reflect light incident from the mirror 14*a* toward the condensing lens 15 in a built-in type as will be described later. In addition, a ratio of a movement amount of the full rate carriage 13 to a movement amount of the half rate carriage 14 is controlled to be 1:0.5 through the carriage transport mechanism. Thereby, a length of an optical path of the illumination light up to the condensing lens 15 is controlled to be constant.

When a document set on the platen glass 11 is scanned, the document is scanned by moving the full rate carriage 13 and the half rate carriage 14 in the scanning direction. On the other hand, when a document is automatically fed by the ADF 20 as will be described later, the full rate carriage 13 and the half rate carriage 14 stay at predetermined document scanning positions and a plurality of set documents are continuously scanned by moving (transporting) the document side.

The condensing lens 15 condenses the light incident from the mirror 14*b* of the half rate carriage 14 so as to form an image on a light receiving surface of the CCD sensor 16. The CCD sensor 16 operates in synchronization with a timing signal supplied from a CCD drive section (not illustrated). The CCD sensor 16 generates an analog voltage signal corresponding to the image of the scanned document by photoelectrically converting the light received on the light receiving surface, and outputs the generated analog voltage signal to an analog front end (AFE) (not illustrated). After amplifying the analog voltage signal with a predetermined gain setting value, the AFE generates document image data representing an image of the scanned document by converting the amplified analog voltage signal into a digital signal. The AFE outputs the document image data to a control section 60 (FIG. 2) of the main body 2 as will be described later.

The ADF 20 continuously and automatically feeds a plurality of documents set on a document loading tray 22 one by one. The ADF 20 includes a platen cover 21, the document loading tray 22, a pickup roller 23, a registration roller 24, a platen roller 25, a paper ejection roller 26, and the like. The platen cover 21 is provided to be opened and closed with respect to the top of the scanner 10. The platen cover 21 functions as a document pressing cover when a document is set and scanned on the platen glass 11 and functions as a housing for housing members for use in an automatic feeding mechanism such as the pickup roller 23, the registration roller 24, the platen roller 25 and the paper ejection roller 26. In FIG. 1, the closed state of the platen cover 21 is illustrated.

The document loading tray 22 is a tray on which documents to be scanned are set. The pickup roller 23 picks up the documents set on the document loading tray 22 one by one and takes out the documents to the registration roller 24. The registration roller 24 transports the documents to the platen roller 25 at a predetermined timing. The platen roller 25 transports the documents to the paper ejection roller 26 via a predetermined document scanning position. The paper ejection roller 26 ejects the scanned documents externally. Rotation operations of the above-described rollers are controlled by the control section 60 of the main body 2.

When the document image data obtained from the document scanning device 1 or the reception image data received from the external device via the communication link is RGB color space data, the main body 2 has a function of converting the image data into image data for printing, which is CMYK color space data (a function of the control section 60 as will be described later). As is known, the RGB color space data is digital data representing a tone value of a pixel (a minimum unit constituting an image) corresponding to each color of red (R), green (G), and blue (B), which are three primary colors of light.

In addition, the CMYK color space data is data representing an image by adding a key plate (K) (color material of black) to three primary colors of color materials (toner in the multifunction peripheral 100) for printing of cyan (C), magenta (M), and yellow (Y). In the multifunction peripheral 100 of the electrographic method, a toner image is formed by superimposing a developed toner image on a photoconductive surface for each color of CMYK. The toner image of each color before the superimposition is formed by a two-dimensional layout of toner arrangement points referred to as dots. That is, the CMYK color space data is binary digital data representing a position in which toner is arranged in the toner image of each color.

The main body 2 includes a toner image forming section 3 configured to form a toner image based on the above-described image data for the printing on printing paper, a fixing section 4 configured to generate a finished image by fixing the toner image on the printing paper, a paper transport mechanism 5 configured to transport the printing paper, and paper feed cassettes 6, 7, and 8 configured to house various sizes of printing paper. Further, the main body 2 is provided with a manual feed tray 9, which can be opened toward a front side and closed, and configured to enable printing paper loaded on the manual feed tray 9 to be transported by the paper transport mechanism 5.

The toner image forming section 3 includes an intermediate transfer belt 31, toner image forming units F (FY, FM, FC, and FK) corresponding respectively to the CMYK colors, a driving roller 32, a driving roller 36, a tension roller 33, a secondary transfer roller 34, and a cleaner 35. The intermediate transfer belt 31 is an intermediate transfer body configured to sequentially superimpose and primarily transfer toner images of colors formed (developed) by the toner image forming units F (FY, FM, FC, and FK). The intermediate transfer belt 31 is configured to be suspended by the driving roller 32, a driving roller 36, and the tension roller 33 and turn clockwise in FIG. 1.

The toner image forming units F (FY, FM, FC, and FK) each include at least a photoconductive drum Fa, a charging unit Fb, an exposing unit Fc, a developing unit Fd, a primary transfer roller Fe, and further include a cleaning device (not illustrated), a de-electrifying device (not illustrated), and the like. The photoconductive drum Fa is set in a cylindrical shape. On its circumference, an electrostatic latent image and a toner image based on the electrostatic latent image are formed. The charging unit Fb is disposed opposite the photoconductive drum Fa and electrifies the circumference of the photoconductive drum Fa.

The exposing unit Fc forms an electrostatic latent image by scanning the electrified circumference of the photoconductive drum Fa with laser light, and specifically radiates laser light to a position on the photoconductive drum Fa corresponding to a dot position at which toner should be disposed.

The developing unit Fd develops the image based on the electrostatic latent image on the circumference of the photoconductive drum Fa by supplying toner to the circumference of the photoconductive drum Fa.

The primary transfer roller Fe is disposed opposite the photoconductive drum Fa with the intermediate transfer belt 31 interposed therebetween and primarily transfers the toner image developed on the photoconductive drum Fa onto the intermediate transfer belt 31. The secondary transfer roller 34 is disposed opposite the driving roller 36 with the intermediate transfer belt 31 interposed therebetween. The secondary transfer roller 34 secondarily transfers the toner image, which has been transferred onto a surface of the intermediate transfer belt 31 (an image in which toner images of colors have been superimposed), onto printing paper transported via the paper transport mechanism 5 from one of the paper feed cassettes 6, 7, and 8. The cleaner 35 includes a cleaning roller, a cleaning blade, and the like to remove the remaining toner on the intermediate transfer belt 31.

The fixing section 4 generates a finished image by fixing the toner image secondarily transferred onto the printing paper. The fixing section 4 includes a heating roller 41 configured to fix the toner image by pressurizing and heating the toner. Also, a heat temperature of the heating roller 41 (that is, a fixing temperature of the fixing section 4) can be controlled by the control section 60 as will be described later.

The paper transport mechanism 5 includes pickup rollers 51, 52 and 53 for taking out printing paper from the paper feed cassettes 6, 7, and 8, paper feed rollers 54, 55 and 56 for transporting the picked-up printing paper to the toner image forming section 3 (a nip portion of the driving roller 36 and the secondary transfer roller 34), a paper ejection roller 57 for ejecting printing paper externally after a fixing process by the fixing section 4, and the like. The paper feed cassettes 6, 7, and 8 are installed to be freely drawn out of the main body 2 and house different sizes of paper.

Figure 2:
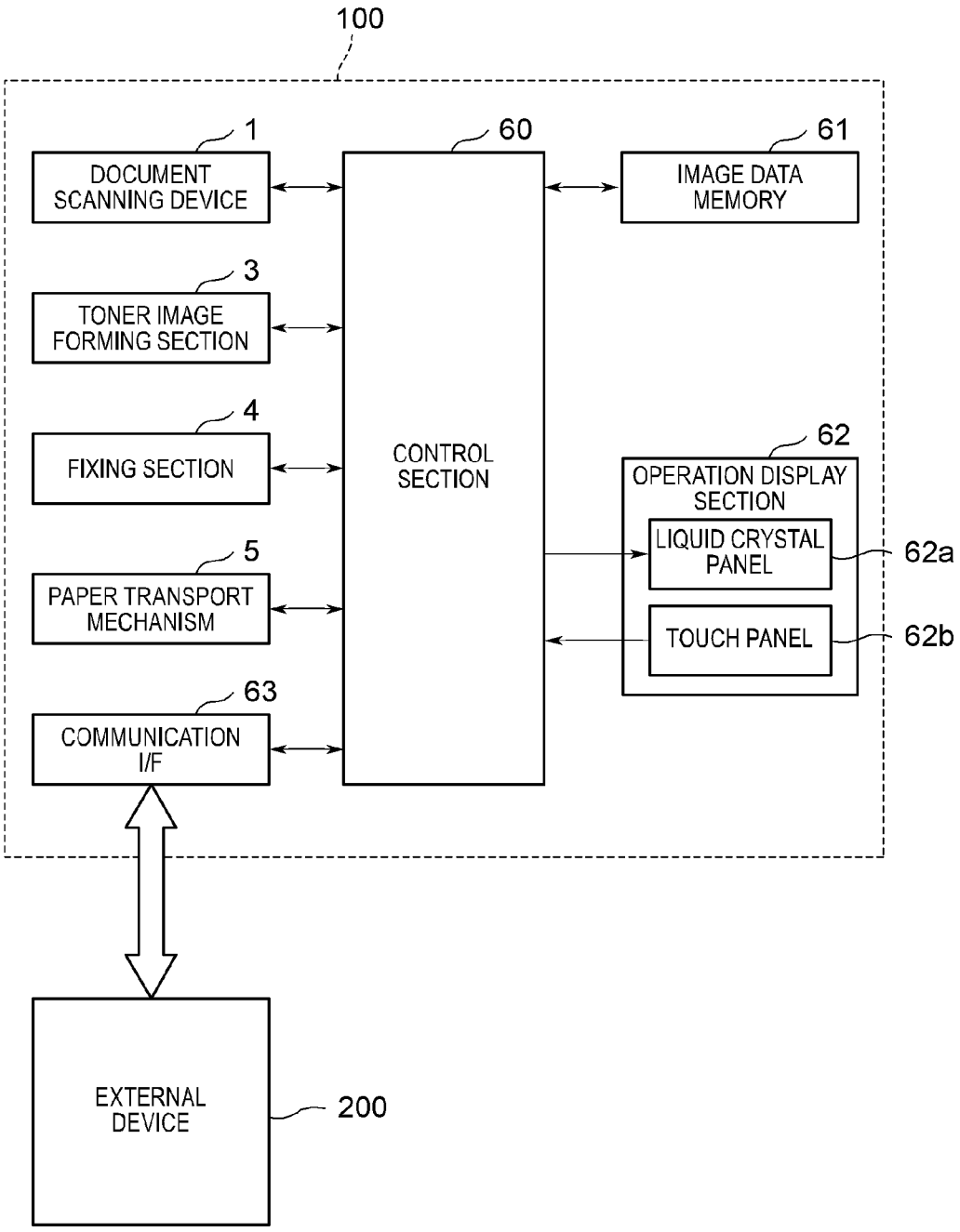
FIG. 2 is a functional block diagram of the multifunction peripheral in accordance with the embodiment.

FIG. 2 is a functional block diagram of the multifunction peripheral 100. The same components of FIG. 2 as in FIG. 1 are assigned the same reference signs and description thereof is omitted. In FIG. 2, reference sign 60 denotes the control section, reference sign 61 denotes an image data memory, reference sign 62 denotes an operation display section, and reference sign 63 denotes a communication interface (I/F). Also, reference sign 200 denotes an external device (for example, a personal computer, a facsimile, or the like) configured to transmit image data to the multifunction peripheral 100.

The control section 60, for example, is a microcomputer in which a central processing unit (CPU) core, a memory such as a read only memory (ROM) or a random access memory (RAM), an input/output I/F, and the like are integrally embedded. The control section 60 controls all operations of the multifunction peripheral 100 (a document scanning operation by the document scanning device 1, a toner image forming operation by the toner image forming section 3, a fixing operation by the fixing section 4, a paper transport operation by the paper transport mechanism 5, and the like) based on an operation signal input from the operation display section 62, document image data obtained from the document scanning device 1, and reception image data received from the external device 200 via the communication I/F 63.

In addition, when the document image data obtained from the document scanning device 1 or the reception image data received from the external device 200 via the communication link is RGB color space data as described above, the control section 60 also has a function of converting the image data into image data for printing, which is CMYK color space data.

The image data memory 61, for example, is a rewritable nonvolatile memory such as a flash memory, and stores image data such as the document image data obtained from the image scanning device 1 or the reception image data received from the external device 200 and the above-described image data for the printing under control by the control section 60.

The operation display section 62, for example, includes a liquid crystal panel 62*a* and a touch panel 62*b*. The liquid crystal panel 62*a* displays a screen for notifying a user of various operation keys or various information under control by the control section 60. The touch panel 62*b* is superimposed and installed on the above-described liquid crystal panel 62*a*, and outputs operation input information corresponding to an operation input of the user for various operation keys displayed on the liquid crystal panel 62*a* as an operation signal to the control section 60.

The communication I/F 63 is an I/F for performing communication between the multifunction peripheral 100 (specifically, the control section 60) and the external device 200, and is communicably connected to the external device 200 through a network such as a local area network (LAN).

Next, an operation of the multifunction peripheral 100 configured as described above will be described.

The control section 60 in this embodiment has an uneven brightness prevention function of calculating a size parameter associated with a size of a uniform density region included in a toner image based on image data for printing (CMYK color space data) and controlling the fixing temperature of the fixing section 4 (the heat temperature of the heating roller 41) according to the calculation result as its characteristic function. Although first to sixth processes to be executed by the control section 60 to implement the uneven brightness prevention function will be described hereinafter, one of these processes may be adopted.

<First Process for Implementing Uneven Brightness Prevention Function>

Figure 3:
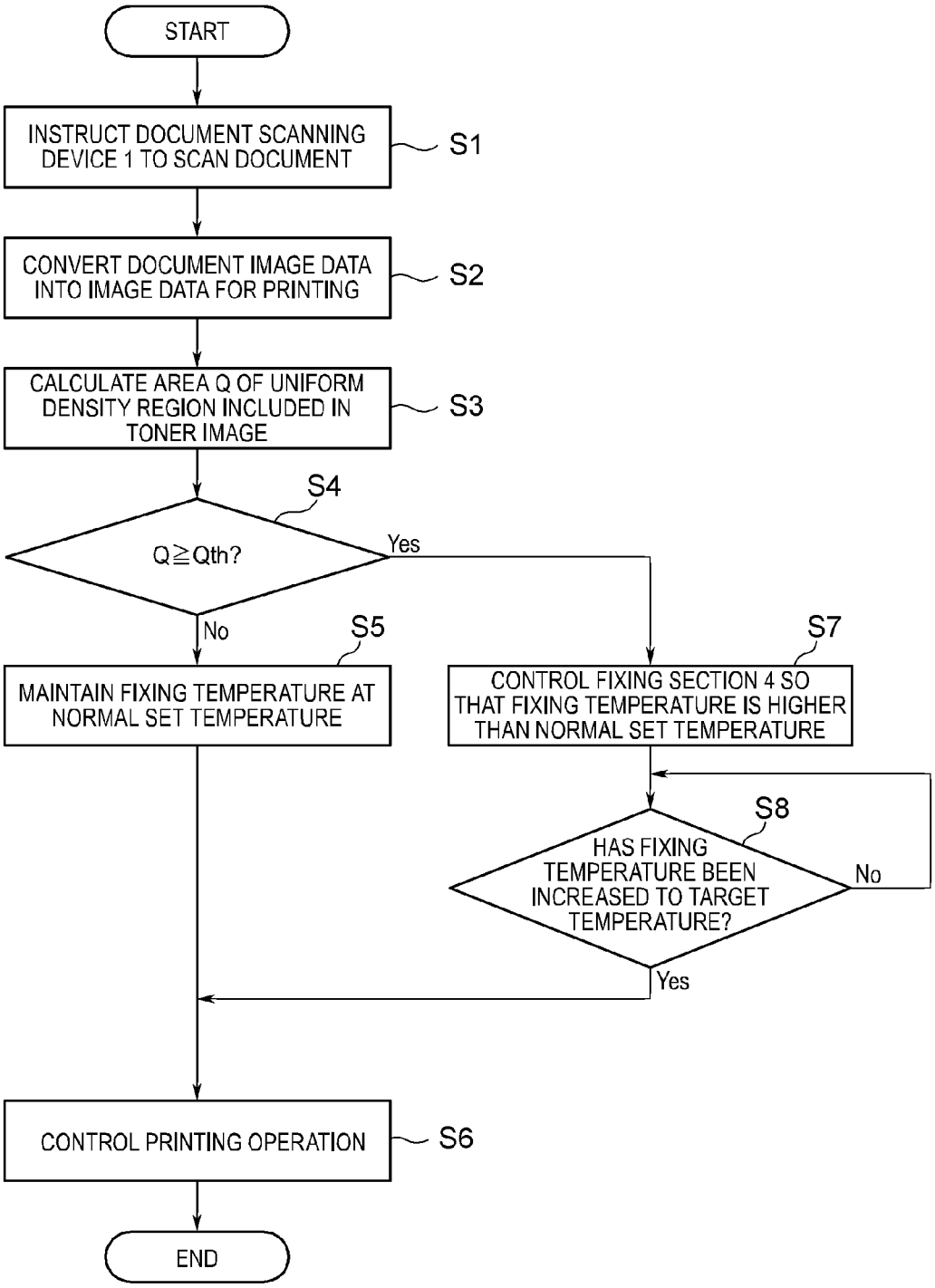
FIG. 3 is a flowchart illustrating a first process to be executed by a control section of the multifunction peripheral to implement an uneven brightness prevention function.

FIG. 3 is a flowchart illustrating the first process to be executed by the control section 60 to implement the uneven brightness prevention function. When sensing that the user has pressed a copy start key based on an operation signal input from the operation display section 62, the control section 60 starts the first process illustrated in FIG. 3. Also, hereinafter, the case in which the copy start key has been pressed after the user has set a document on the platen glass 11 is assumed.

As illustrated in FIG. 3, when sensing that the user has pressed the copy start key, the control section 60 instructs the document scanning device 1 to scan the document set on the platen glass 11 (step S1). Thereby, the document scanning device 1 scans the document set on the platen glass 11, generates document image data of the RGB color space format representing an image of the scanned document, and outputs the generated document image data to the control section 60.

Subsequently, the control section 60 causes the image data memory 61 to store the document image data of the RGB color space format acquired from the document scanning device 1 as described above, converts the document image data into image data for printing of the CMYK color space format, and also causes the image data memory 61 to store the image data for the printing (step S2).

Subsequently, the control section 60 detects a uniform density region in which toner is uniformly distributed in a toner image when the toner image has been formed by the image data for the printing based on the image data for the printing read from the image data memory 61, and calculates an area Q of the uniform density region as a size parameter associated with the uniform density region (step S3).

The above-described uniform density region, for example, is a region such as a solid region or a half-tone region in the above-described toner image, and indicates a region perceived by a human eye as a uniform density when dots on which toner is disposed are closely spaced and densely populated or collected at a given interval.

If there are many uniform density regions in a toner image as described above, uneven brightness is likely to occur in a finished image on printing paper after a fixing process due to variation in melting of toner in the uniform density regions and other regions in the fixing process on the printing paper on which the toner image has been formed (transferred) at a given temperature.

Also, the area Q of the uniform density region may be separately calculated for each of toner images of colors of CMYK or may be calculated for a toner image in which the toner images of the colors are superimposed and integrally formed. In addition, when there are a plurality of uniform density regions, it is only necessary to set a sum of areas of uniform density regions as Q. In addition, because the area Q of the uniform density region has a proportional relationship with the number of dots within the uniform density region, the calculation is easy when the area Q of the uniform density region is replaced with the number of dots. Accordingly, in step S3, the number of dots within the uniform density region may be calculated instead of the area Q of the uniform density region.

Subsequently, the control section 60 compares the area Q of the uniform density region calculated as described above to a threshold value Qth, and determines whether the area Q of the uniform density region is greater than or equal to the threshold value Qth (step S4). Here, the threshold value Qth is set to a minimum area of the uniform density region (for example, vertical 3 mm×horizontal 3 mm, the number of dots is 70) in which variation is perceived by the human eye as uneven brightness when the variation has occurred in melting of toner in the uniform density region and other regions.

Because there is no concern that variation is perceived by the human eye as uneven brightness even when the variation has occurred in melting of toner in the uniform density region and other regions in the case of "No" in the above-described step S4, that is, when the area Q of the uniform density region is less than the threshold value Qth, the control section 60 maintains the fixing temperature of the fixing section 4 at a normal set temperature (step S5). Also, when the area Q of the uniform density region has been separately calculated for each of the toner images of the colors of CMYK, the process proceeds to the process of the above-described step S5 if all areas Q of the uniform density regions for the toner images of the colors are less than the threshold value Qth.

Therefore, the control section 60 prints an image of a document scanned by the document scanning device 1 on printing paper by controlling the toner image forming operation by the toner image forming section 3, the fixing operation by the fixing section 4, and the paper transport operation by the paper transport mechanism 5 based on the image data for the printing (step S6). Here, although the fixing temperature of the fixing section 4 remains as a normal set temperature in the process of fixing printing paper on which a toner image has been formed, there is no concern that variation is perceived by the human eye as uneven brightness of an image ultimately finished on printing paper even when the variation has occurred in melting of toner in a uniform density region and other regions because the area Q of the uniform density region included in the toner image is less than the threshold value Qth as described above.

On the other hand, because variation is likely to be perceived by the human eye as the uneven brightness when the variation has occurred in melting of toner in the uniform density region and the other regions in the case of "Yes" in the above-described step S4, that is, when the area Q of the uniform density region is greater than or equal to the threshold value Qth, the control section 60 controls the fixing section 4 (the heating roller 41) so that the fixing temperature of the fixing section 4 is higher than the normal set temperature, that is, so that the fixing temperature of the fixing section 4 becomes a target temperature having a higher value than the normal set temperature (as in the following embodiments) (step S7). For example, the control section 60 retains a predetermined target temperature according to a magnitude of an area Q of the uniform density region or calculates the target temperature by multiplying the magnitude of the area Q by a coefficient, and controls the fixing section 4 using the target temperature. In this case, the target temperature is a temperature at which toner in the uniform density region having the area Q can be melted and fixed, and is a temperature at which no hot offset occurs. Hereinafter, a target temperature of the uniform density region having an area ratio QR or a data amount D in the second and third embodiments is similar thereto. Also, when the area Q of the uniform density region has been separately calculated for each of the toner images of the colors of CMYK, the process proceeds to the process of the above-described step S7 if at least one of the areas Q of the uniform density regions for the toner images of the colors is greater than or equal to the threshold value Qth.

Therefore, the control section 60 determines whether a fixing temperature from an output signal of a temperature sensor (not illustrated) mounted on the heating roller 41 has been increased to the target temperature (step S8). In the case of "No," the control section 60 waits until the fixing temperature reaches the target temperature by iterating the process of step S8. On the other hand, in the case of "Yes," the process proceeds to the process of step S6, and the control section 60 controls the toner image forming operation by the toner image forming section 3, the fixing operation by the fixing section 4, and the paper transport operation by the paper transport mechanism 5, for printing an image of a document scanned by the document scanning device 1 on printing paper based on image data for printing.

Here, even when the area Q of the uniform density region included in the toner image is greater than or equal to the threshold value Qth because the fixing temperature of the fixing section 4 is higher than the normal set temperature in a process of fixing printing paper on which a toner image has been formed, it is possible to suppress the occurrence of the variation in melting of toner in the uniform density region and the other regions, and it is possible to suppress the occurrence of the uneven brightness in the image ultimately finished on the printing paper.

As described above, in the first process, the control section 60 calculates the area Q of the uniform density region as a size parameter of the uniform density region included in the toner image and controls the fixing section 4 so that the fixing temperature of the fixing section 4 is higher than the normal set temperature when the calculated area Q of the uniform density region is greater than or equal to the threshold value Qth. Thereby, it is possible to suppress the occurrence of the variation in melting of toner in the uniform density region and the other regions and consequently it is possible to obtain a high-quality image by suppressing the occurrence of the uneven brightness.

<Second Process for Implementing Uneven Brightness Prevention Function>

Figure 4:
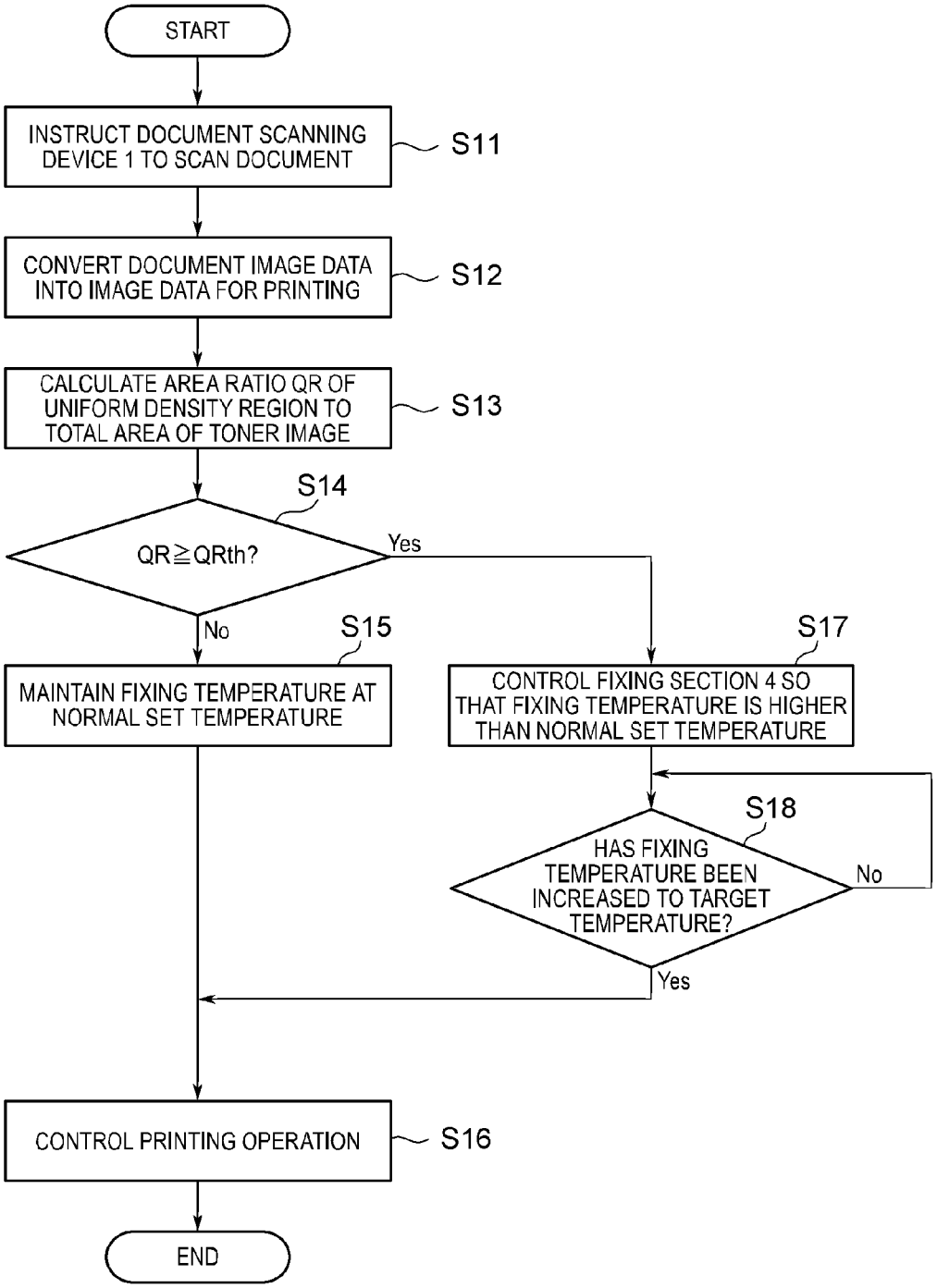
FIG. 4 is a flowchart illustrating a second process to be executed by the control section of the multifunction peripheral to implement the uneven brightness prevention function.

FIG. 4 is a flowchart illustrating the second process to be executed by the control section 60 to implement the uneven brightness prevention function. When sensing that the user has pressed the copy start key based on an operation signal input from the operation display section 62, the control section 60 starts the second process illustrated in FIG. 4. Also, hereinafter, the case in which the copy start key has been pressed after the user has set a document on the platen glass 11 is assumed.

As illustrated in FIG. 4, when sensing that the user has pressed the copy start key, the control section 60 instructs the document scanning device 1 to scan the document set on the platen glass 11 (step S11). Thereby, the document scanning device 1 scans the document set on the platen glass 11, generates document image data of the RGB color space format representing an image of the scanned document, and outputs the generated document image data to the control section 60.

Subsequently, the control section 60 causes the image data memory 61 to store the document image data of the RGB color space format acquired from the document scanning device 1 as described above, converts the document image data into image data for printing of the CMYK color space format, and also causes the image data memory 61 to store the image data for the printing (step S12).

Subsequently, the control section 60 reads the image data for the printing from the image data memory 61, and calculates the area ratio QR of a uniform density region to a total area of a toner image as a size parameter associated with a size of the uniform density region included in the toner image based on the read image data for the printing (step S13).

Also, the area ratio QR of the uniform density region may be separately calculated for each of toner images of colors of CMYK or may be calculated for a toner image in which the toner images of the colors are superimposed and integrally formed. In addition, when there are a plurality of uniform density regions, an area ratio QR can be calculated from a sum of areas of the uniform density regions. In addition, in order to facilitate the calculation, a ratio of the number of dots of the uniform density region to the total number of dots of the toner image may be calculated instead of the area ratio QR of the uniform density region.

Subsequently, the control section 60 compares the area ratio QR of the uniform density region calculated as described above to a threshold value QRth, and determines whether the area ratio QR of the uniform density region is greater than or equal to the threshold value QRth (step S14). Here, the threshold value QRth is set to a minimum area ratio of the uniform density region at which variation is perceived by the human eye as uneven brightness when the variation has occurred in melting of toner in the uniform density region and other regions.

Because there is no concern that variation is perceived by the human eye as uneven brightness even when the variation has occurred in melting of toner in the uniform density region and the other regions in the case of "No" in the above-described step S14, that is, when the area ratio QR of the uniform density region is less than the threshold value QRth, the control section 60 maintains the fixing temperature of the fixing section 4 in a normal set temperature (step S15). Also, when the area ratio QR of the uniform density region has been separately calculated for each of the toner images of the colors of CMYK, the process proceeds to the process of the above-described step S15 if all area ratios QR of the uniform density regions for the toner images of the colors are less than the threshold value QRth.

Therefore, the control section 60 prints an image of a document scanned by the document scanning device 1 on printing paper by controlling the toner image forming operation by the toner image forming section 3, the fixing operation by the fixing section 4, and the paper transport operation by the paper transport mechanism 5 based on image data for printing (step S16). Here, although the fixing temperature of the fixing section 4 remains at a normal set temperature in the process of fixing printing paper on which the toner image has been formed, there is no concern that the variation is perceived by the human eye as the uneven brightness of image ultimately finished on the printing paper even when the variation has occurred in melting of toner in the uniform density region and the other regions because the area ratio QR of the uniform density region included in the toner image is less than the threshold value QRth as described above.

On the other hand, because the variation is likely to be perceived by the human eye as the uneven brightness when the variation has occurred in melting of toner in the uniform density region and the other regions in the case of "Yes" in the above-described step S14, that is, when the area ratio QR of the uniform density region is greater than or equal to the threshold value QRth, the control section 60 controls the fixing section 4 so that the fixing temperature of the fixing section 4 is higher than the normal set temperature (step S17).

Also, when the area ratio QR of the uniform density region has been separately calculated for each of the toner images of the colors of CMYK, the process proceeds to the process of the above-described step S17 if at least one of the area ratios QR of the uniform density regions for the toner images of the colors is greater than or equal to the threshold value QRth.

Therefore, the control section 60 determines whether a fixing temperature from an output signal of the temperature sensor mounted on the heating roller 41 has been increased to the target temperature (step S18). In the case of "No," the control section 60 waits until the fixing temperature reaches the target temperature by iterating the process of step S18. On the other hand, in the case of "Yes," the process proceeds to the process of step S16, and the control section 60 controls the toner image forming operation by the toner image forming section 3, the fixing operation by the fixing section 4, and the paper transport operation by the paper transport mechanism 5, for printing an image of a document scanned by the document scanning device 1 on printing paper based on image data for printing.

Here, even when the area ratio QR of the uniform density region included in the toner image is greater than or equal to the threshold value QRth because the fixing temperature of the fixing section 4 is higher than the normal set temperature in a process of fixing printing paper on which a toner image has been formed, it is possible to suppress the occurrence of the variation in melting of toner in the uniform density region and the other regions, and it is possible to suppress the occurrence of uneven brightness in the image ultimately finished on the printing paper.

As described above, in the second process, the control section 60 calculates the area ratio QR of the uniform density region as a size parameter of the uniform density region included in the toner image and controls the fixing section 4 so that the fixing temperature of the fixing section 4 is higher than the normal set temperature when the area ratio QR of the uniform density region is greater than or equal to the threshold value QRth. Thereby, it is possible to suppress the occurrence of the variation in melting of toner in the uniform density region and the other regions and consequently it is possible to obtain a high-quality image by suppressing the occurrence of uneven brightness.

<Third Process for Implementing Uneven Brightness Prevention Function>

Figure 5:
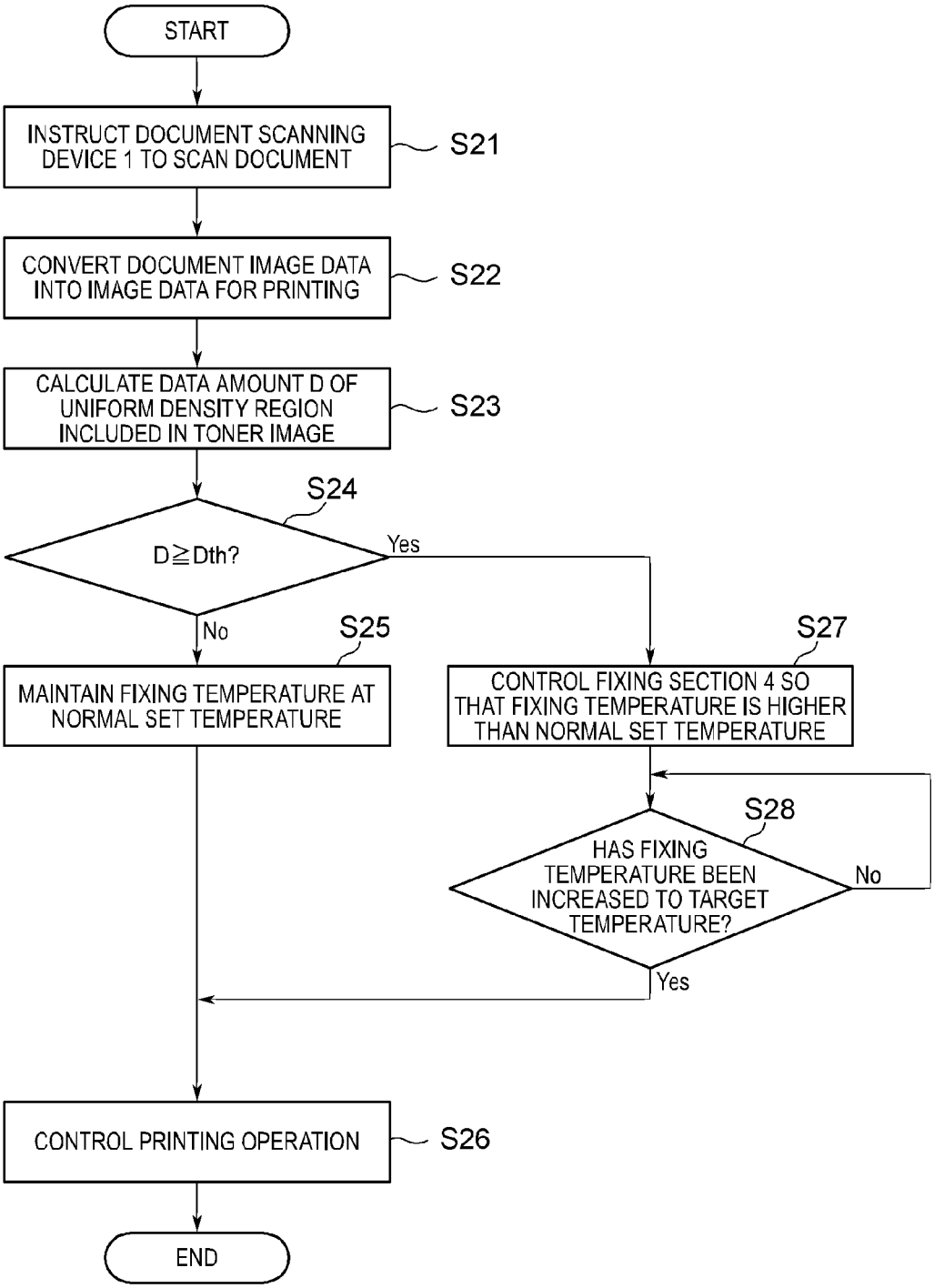
FIG. 5 is a flowchart illustrating a third process to be executed by the control section of the multifunction peripheral to implement the uneven brightness prevention function.

FIG. 5 is a flowchart illustrating the third process to be executed by the control section 60 to implement the uneven brightness prevention function. When sensing that the user has pressed the copy start key based on an operation signal input from the operation display section 62, the control section 60 starts the third process illustrated in FIG. 5. Also, hereinafter, the case in which the copy start key has been pressed after the user has set a document on the platen glass 11 is assumed.

As illustrated in FIG. 5, when sensing that the user has pressed the copy start key, the control section 60 instructs the document scanning device 1 to scan the document set on the platen glass 11 (step S21). Thereby, the document scanning device 1 scans the document set on the platen glass 11, generates document image data of the RGB color space format representing an image of the scanned document, and outputs the generated document image data to the control section 60.

Subsequently, the control section 60 causes the image data memory 61 to store the document image data of the RGB color space format acquired from the document scanning device 1 as described above, converts the document image data into image data for printing of the CMYK color space format, and also causes the image data memory 61 to store the image data for the printing (step S22).

Subsequently, the control section 60 reads the image data for the printing read from the image data memory 61, and calculates a data amount D of a uniform density region as a size parameter associated with the uniform density region included in the toner image based on the read image data for the printing (step S23). Here, the control section 60 calculates the data amount D of the uniform density region for a toner image in which toner images of colors of CMYK are superimposed and integrally formed.

The data amount D, for example, is a value indicating a toner amount in the uniform density region. As this data amount D, a sum of pixel values of pixels constituting a data part corresponding to the above-described uniform density region in the image data for the printing is used. This is because a density indicated by the sum of the pixel values of the pixels corresponds to a toner amount to be used in the above-described uniform density region.

First, the data amount D is calculated for a toner image of each color of CMYK, and a sum of data amounts D of colors serves as a data amount D of the above-described uniform density region. Thus, for example, if the data amount D of the uniform density region corresponding to a single color solid area (100% density region) is a ratio of 100% to a data amount D serving as a maximum value in the region, the control section 60 performs the calculation by increasing a value of the data amount D until the data amount D of the uniform density region in which solid regions of two colors have been superimposed reaches 200%, the data amount D of the uniform density region in which solid regions of three colors have been superimposed reaches 300%, and the data amount D of the uniform density region in which solid regions of four colors have been superimposed reaches 400%. In addition, likewise, the control section 60, for example, adds a data amount D of a uniform density region corresponding to a single color half tone region (50% density region) at 50%. Thus, the data amount D of the uniform density region in which a solid region of one color and a half tone region of one color have been superimposed becomes 150%.

Subsequently, the control section 60 compares the data amount D of the uniform density region calculated as described above to a threshold value Dth, and determines whether the data amount D of the uniform density region is greater than or equal to the threshold value Dth (for example, 100%) (step S24). Here, the threshold value Dth is set to a minimum data amount in which variation is perceived by the human eye as uneven brightness when the variation has occurred in melting of toner in a uniform density region and other regions.

Because there is no concern that variation is perceived by the human eye as uneven brightness even when the variation has occurred in melting of toner in the uniform density region and the other regions in the case of "No" in the above-described step S24, that is, when the data amount D of the uniform density region is less than the threshold value Dth, the control section 60 maintains the fixing temperature of the fixing section 4 at a normal set temperature (step S25).

Therefore, the control section 60 prints an image of a document scanned by the document scanning device 1 on printing paper by controlling the toner image forming operation by the toner image forming section 3, the fixing operation by the fixing section 4, and the paper transport operation by the paper transport mechanism 5 based on image data for printing (step S26). Here, although the fixing temperature of the fixing section 4 remains at a normal set temperature in the process of fixing printing paper on which a toner image has been formed, there is no concern that variation is perceived by the human eye as uneven brightness of an image ultimately finished on the printing paper even when the variation has occurred in melting of toner in a uniform density region and other regions because the data amount D of the uniform density region included in the toner image is less than the threshold value Dth as described above.

On the other hand, because variation is likely to be perceived by the human eye as uneven brightness if the variation has occurred in melting of toner in the uniform density region and the other regions in the case of "Yes" in the above-described step S24, that is, when the data amount D of the uniform density region is greater than or equal to the threshold value Dth, the control section 60 controls the fixing section 4 so that the fixing temperature of the fixing section 4 is higher than the normal set temperature (step S27).

Therefore, the control section 60 determines whether a fixing temperature from an output signal of the temperature sensor mounted on the heating roller 41 has been increased to the target temperature (step S28). In the case of "No," the control section 60 waits until the fixing temperature reaches the target temperature by iterating the process of step S28. On the other hand, in the case of "Yes," the process proceeds to the process of step S26, and the control section 60 controls the toner image forming operation by the toner image forming section 3, the fixing operation by the fixing section 4, and the paper transport operation by the paper transport mechanism 5, for printing an image of a document scanned by the document scanning device 1 on printing paper based on image data for printing.

Here, even when the data amount D of the uniform density region included in the toner image is greater than or equal to the threshold value Dth because the fixing temperature of the fixing section 4 is higher than the normal set temperature in a process of fixing printing paper on which a toner image has been formed, it is possible to suppress the occurrence of the variation in melting of toner in the uniform density region and the other regions, and it is possible to suppress the occurrence of uneven brightness in the image ultimately finished on the printing paper.

As described above, in the third process, the control section 60 calculates the data amount D of the uniform density region as a size parameter of the uniform density region included in the toner image and controls the fixing section 4 so that the fixing temperature of the fixing section 4 is higher than the normal set temperature when the data amount D of the uniform density region is greater than or equal to the threshold value Dth. Thereby, it is possible to suppress the occurrence of the variation in melting of toner in the uniform density region and the other regions and consequently it is possible to obtain a high-quality image by suppressing the occurrence of uneven brightness.

<Fourth Process for Implementing Uneven Brightness Prevention Function>

Figure 6:
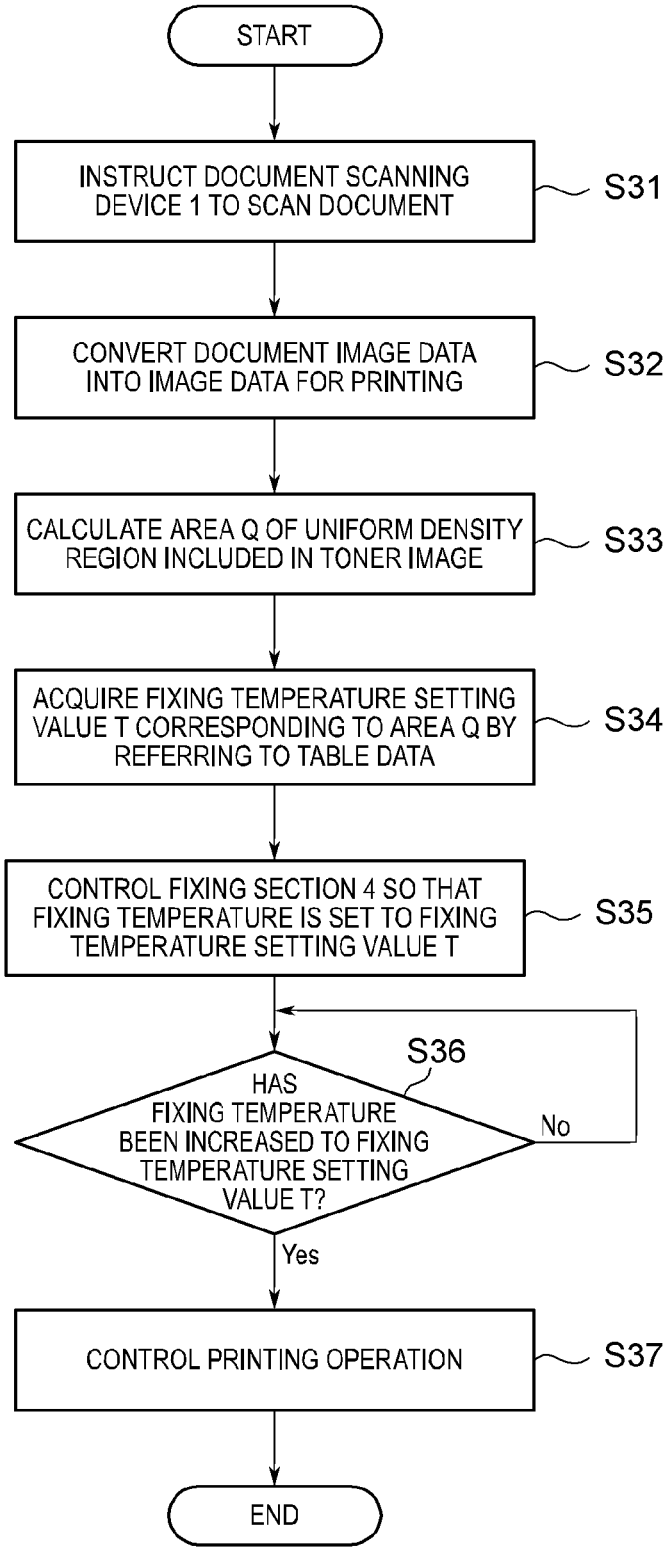
FIG. 6 is a flowchart illustrating a fourth process to be executed by the control section to implement the uneven brightness prevention function.

FIG. 6 is a flowchart illustrating the fourth process to be executed by the control section 60 to implement the uneven brightness prevention function. When sensing that the user has pressed the copy start key based on an operation signal input from the operation display section 62, the control section 60 starts the fourth process illustrated in FIG. 6. Also, hereinafter, the case in which the copy start key has been pressed after the user has set a document on the platen glass 11 is assumed.

As illustrated in FIG. 6, when sensing that the user has pressed the copy start key, the control section 60 instructs the document scanning device 1 to scan the document set on the platen glass 11 (step S31). Thereby, the document scanning device 1 scans the document set on the platen glass 11, generates document image data of the RGB color space format representing an image of the scanned document, and outputs the generated document image data to the control section 60.

Subsequently, the control section 60 causes the image data memory 61 to store the document image data of the RGB color space format acquired from the document scanning device 1 as described above, converts the document image data into image data for printing of the CMYK color space format, and also causes the image data memory 61 to store the image data for the printing (step S32).

Subsequently, the control section 60 reads the image data for the printing read from the image data memory 61, and calculates an area Q of a uniform density region as a size parameter associated with the size of the uniform density region included in the toner image based on the read image data for the printing (step S33). Here, the control section 60 calculates the area Q of the uniform density region for a toner image in which toner images of colors of CMYK are superimposed and integrally formed.

In addition, it is only necessary to set a sum of areas of uniform density regions as Q when there are a plurality of uniform density regions. In addition, because the area Q of the uniform density region has a proportional relationship with the number of dots within the uniform density region, the calculation is easy when the area Q of the uniform density region is replaced with the number of dots. Accordingly, in step S33, the number of dots within the uniform density region may be calculated instead of the area Q of the uniform density region.

Subsequently, the control section 60 acquires a fixing temperature setting value T corresponding to the area Q of the uniform density region calculated in the above-described step S33 by referring to table data representing a preset correspondence relationship between the area Q of the uniform density region and the fixing temperature setting value T as illustrated in FIG. 7 (step S34). As illustrated in FIG. 7, when the area Q of the uniform density region is larger in the above-described table data, the fixing temperature setting value T is also set to be larger. In addition, each fixing temperature setting value T is set to a value in which no uneven brightness occurs for the area Q of the uniform density region. In this case, the fixing temperature setting value T is a temperature at which toner in the uniform density region including the area Q can be melted and fixed, and has a value at which no hot offset occurs (hereinafter, the fixing temperature setting value T of the uniform density region including the area ratio QR or the data amount D in the fifth to seventh embodiments is similar thereto).

Subsequently, the control section 60 controls the fixing section 4 so that the fixing temperature of the fixing section 4 is set to the fixing temperature setting value T acquired in the above-described step S34 (step S35).

Therefore, the control section 60 determines whether a fixing temperature from an output signal of the temperature sensor (not illustrated) mounted on the heating roller 41 has been increased to the fixing temperature setting value T (step S36). In the case of "No," the control section 60 waits until the fixing temperature reaches the fixing temperature setting value T by iterating the process of step S36. On the other hand, in the case of "Yes," the control section 60 controls the toner image forming operation by the toner image forming section 3, the fixing operation by the fixing section 4, and the paper transport operation by the paper transport mechanism 5, for printing an image of a document scanned by the document scanning device 1 on printing paper based on image data for printing (step S37).

As described above, in the fourth process, the control section 60 calculates the area Q of the uniform density region as a size parameter of the uniform density region included in the toner image, acquires the fixing temperature setting value T corresponding to the calculated area Q of the uniform density region by referring to table data representing a preset correspondence relationship between the area Q of the uniform density region and the fixing temperature setting value T, and controls the fixing section 4 so that the fixing temperature of the fixing section 4 is set to the acquired fixing temperature setting value T. Thereby, it is possible to properly and precisely set the fixing temperature according to the area Q of the uniform density region and consequently it is possible to obtain a high-quality image by suppressing the occurrence of uneven brightness.

<Fifth Process for Implementing Uneven Brightness Prevention Function>

Figure 8:
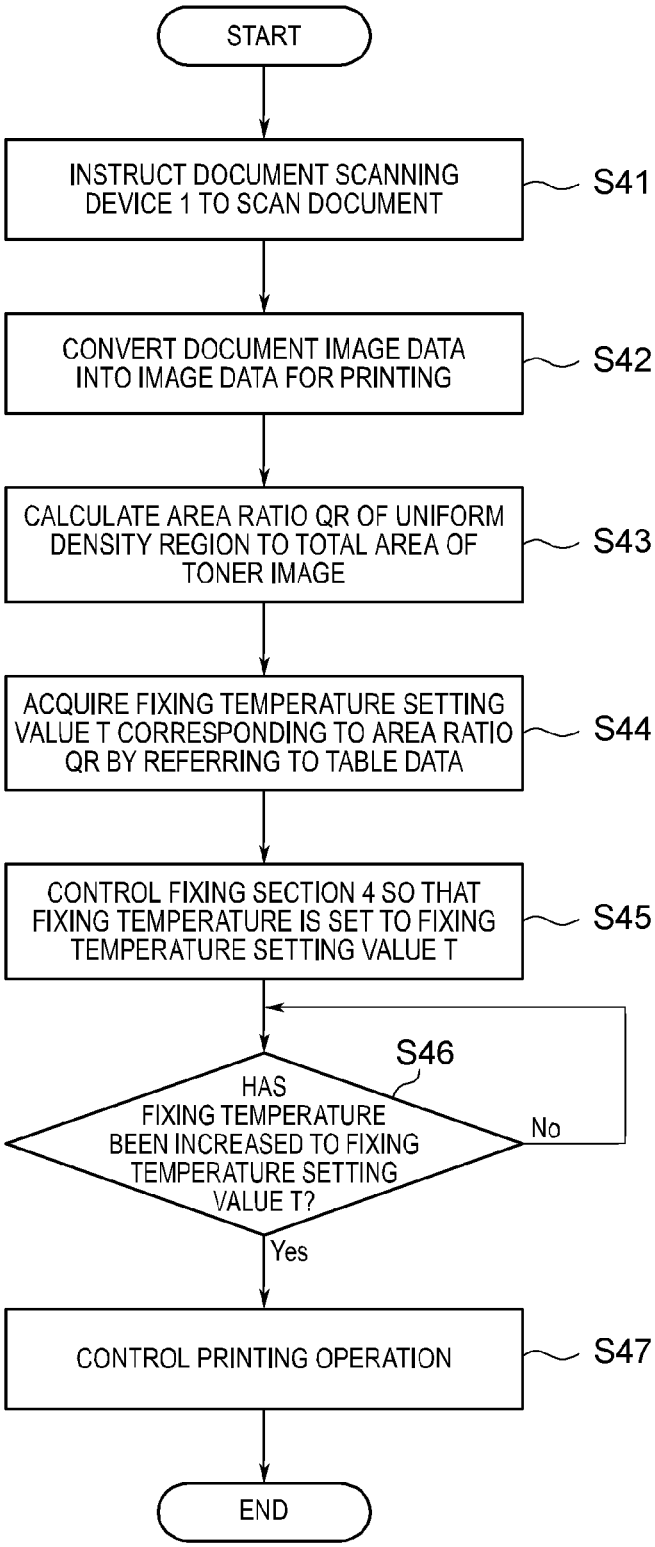
FIG. 8 is a flowchart illustrating a fifth process to be executed by the control section to implement the uneven brightness prevention function.

FIG. 8 is a flowchart illustrating the fifth process to be executed by the control section 60 to implement the uneven brightness prevention function. When sensing that the user has pressed the copy start key based on an operation signal input from the operation display section 62, the control section 60 starts the fifth process illustrated in FIG. 8. Also, hereinafter, the case in which the copy start key has been pressed after the user has set a document on the platen glass 11 is assumed.

As illustrated in FIG. 8, when sensing that the user has pressed the copy start key, the control section 60 instructs the document scanning device 1 to scan the document set on the platen glass 11 (step S41). Thereby, the document scanning device 1 scans the document set on the platen glass 11, generates document image data of the RGB color space format representing an image of the scanned document, and outputs the generated document image data to the control section 60.

Subsequently, the control section 60 causes the image data memory 61 to store the document image data of the RGB color space format acquired from the document scanning device 1 as described above, converts the document image data into image data for printing of the CMYK color space format, and also causes the image data memory 61 to store the image data for the printing (step S42).

Subsequently, the control section 60 reads image data for printing from the image data memory 61, and calculates an area ratio QR of a uniform density region to a total area of a toner image as a size parameter associated with a size of the uniform density region included in the toner image based on the read image data for the printing (step S43). Here, the control section 60 calculates the area ratio QR of the uniform density region for a toner image in which toner images of colors of CMYK are superimposed and integrally formed.

Also, when there are a plurality of uniform density regions, an area ratio QR can be calculated from a sum of areas of the uniform density regions. In addition, in order to facilitate the calculation, a ratio of the number of dots of the uniform density region to the total number of dots of the toner image may be calculated instead of the area ratio QR of the uniform density region.

Subsequently, the control section 60 acquires a fixing temperature setting value T corresponding to the area ratio QR of the uniform density region calculated in the above-described step S43 by referring to table data representing a preset correspondence relationship between the area ratio QR of the uniform density region and the fixing temperature setting value T as illustrated in FIG. 9 (step S44). As illustrated in FIG. 9, when the area ratio QR of the uniform density region is larger in the above-described table data, the fixing temperature setting value T is also set to be larger.

In addition, each fixing temperature setting value T is set to a value in which no uneven brightness occurs for the area ratio QR of the uniform density region.

Subsequently, the control section 60 controls the fixing section 4 so that the fixing temperature of the fixing section 4 is set to the fixing temperature setting value T acquired in the above-described step S44 (step S45).

Therefore, the control section 60 determines whether a fixing temperature from an output signal of the temperature sensor (not illustrated) mounted on the heating roller 41 has been increased to the fixing temperature setting value T (step S46). In the case of "No," the control section 60 waits until the fixing temperature reaches the fixing temperature setting value T by iterating the process of step S46. On the other hand, in the case of "Yes," the control section 60 controls the toner image forming operation by the toner image forming section 3, the fixing operation by the fixing section 4, and the paper transport operation by the paper transport mechanism 5, for printing an image of a document scanned by the document scanning device 1 on printing paper based on image data for printing (step S47).

As described above, in the fifth process, the control section 60 calculates the area ratio QR of the uniform density region to a total area of the toner image as a size parameter of the uniform density region included in the toner image, acquires the fixing temperature setting value T corresponding to the calculated area ratio QR of the uniform density region by referring to table data representing a preset correspondence relationship between the area ratio QR of the uniform density region and the fixing temperature setting value T, and controls the fixing section 4 so that the fixing temperature of the fixing section 4 is set to the acquired fixing temperature setting value T. Thereby, it is possible to properly and precisely set the fixing temperature according to the area ratio QR of the uniform density region and consequently it is possible to obtain a high-quality image by suppressing the occurrence of uneven brightness.

<Sixth Process for Implementing Uneven Brightness Prevention Function>

Figure 10:
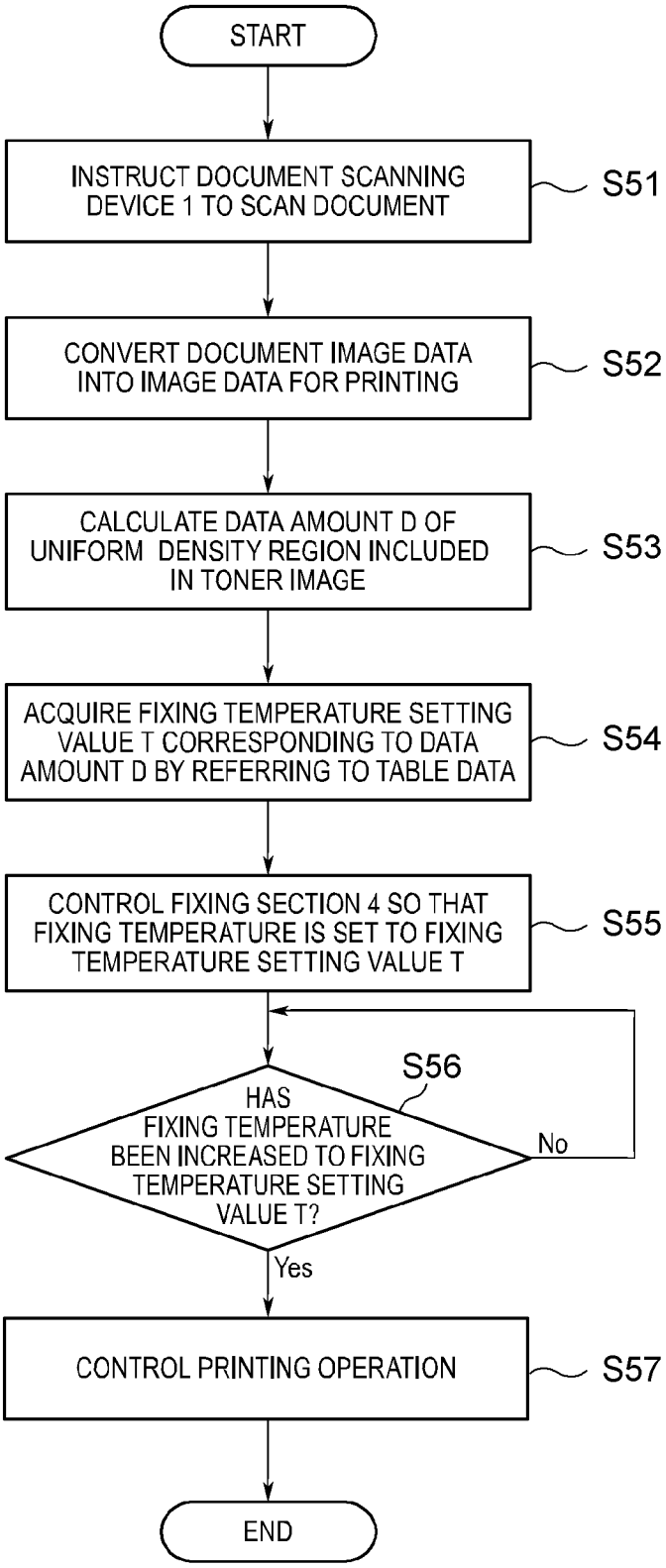
FIG. 10 is a flowchart illustrating a sixth process to be executed by the control section to implement the uneven brightness prevention function.

FIG. 10 is a flowchart illustrating the sixth process to be executed by the control section 60 to implement the uneven brightness prevention function. When sensing that the user has pressed the copy start key based on an operation signal input from the operation display section 62, the control section 60 starts the sixth process illustrated in FIG. 10. Also, hereinafter, the case in which the copy start key has been pressed after the user has set a document on the platen glass 11 is assumed.

As illustrated in FIG. 10, when sensing that the user has pressed the copy start key, the control section 60 instructs the document scanning device 1 to scan the document set on the platen glass 11 (step S51). Thereby, the document scanning device 1 scans the document set on the platen glass 11, generates document image data of the RGB color space format representing an image of the scanned document, and outputs the generated document image data to the control section 60.

Subsequently, the control section 60 causes the image data memory 61 to store the document image data of the RGB color space format acquired from the document scanning device 1 as described above, converts the document image data into image data for printing of the CMYK color space format, and also causes the image data memory 61 to store the image data for the printing (step S52).

Subsequently, the control section 60 reads the image data for the printing read from the image data memory 61, and calculates a data amount D of a uniform density region as a size parameter associated with the size of the uniform density region included in the toner image based on the read image data for the printing (step S53). Here, the control section 60 calculates the data amount D of the uniform density region for a toner image in which toner images of colors of CMYK are superimposed and integrally formed (a method of calculating the data amount D is similar to that of the third process).

Subsequently, the control section 60 acquires a fixing temperature setting value T corresponding to the data amount D of the uniform density region calculated in step S53 by referring to table data representing a preset correspondence relationship between the data amount D of the uniform density region and the fixing temperature setting value T as illustrated in FIG. 11 (step S54). As illustrated in FIG. 11, when the data amount D of the uniform density region is larger in the above-described table data, the fixing temperature setting value T is also set to be larger. In addition, each fixing temperature setting value T is set to a value in which no uneven brightness occurs for the data amount D of the uniform density region.

Subsequently, the control section 60 controls the fixing section 4 so that the fixing temperature of the fixing section 4 is set to the fixing temperature setting value T acquired in the above-described step S54 (step S55).

Therefore, the control section 60 determines whether a fixing temperature from an output signal of the temperature sensor (not illustrated) mounted on the heating roller 41 has been increased to the fixing temperature setting value T (step S56). In the case of "No," the control section 60 waits until the fixing temperature reaches the fixing temperature setting value T by iterating the process of step S56. On the other hand, in the case of "Yes," the control section 60 controls the toner image forming operation by the toner image forming section 3, the fixing operation by the fixing section 4, and the paper transport operation by the paper transport mechanism 5, for printing an image of a document scanned by the document scanning device 1 on printing paper based on image data for printing (step S57).

As described above, in the sixth process, the control section 60 calculates the data amount D of the uniform density region as a size parameter of the uniform density region included in the toner image, acquires the fixing temperature setting value T corresponding to the calculated data amount D of the uniform density region by referring to table data representing a preset correspondence relationship between the data amount D of the uniform density region and the fixing temperature setting value T, and controls the fixing section 4 so that the fixing temperature of the fixing section 4 is set to the acquired fixing temperature setting value T. Thereby, it is possible to properly and precisely set the fixing temperature according to the data amount D of the uniform density region and consequently it is possible to obtain a high-quality image by suppressing the occurrence of uneven brightness.

<Seventh Process for Implementing Uneven Brightness Prevention Function>

Figure 12:
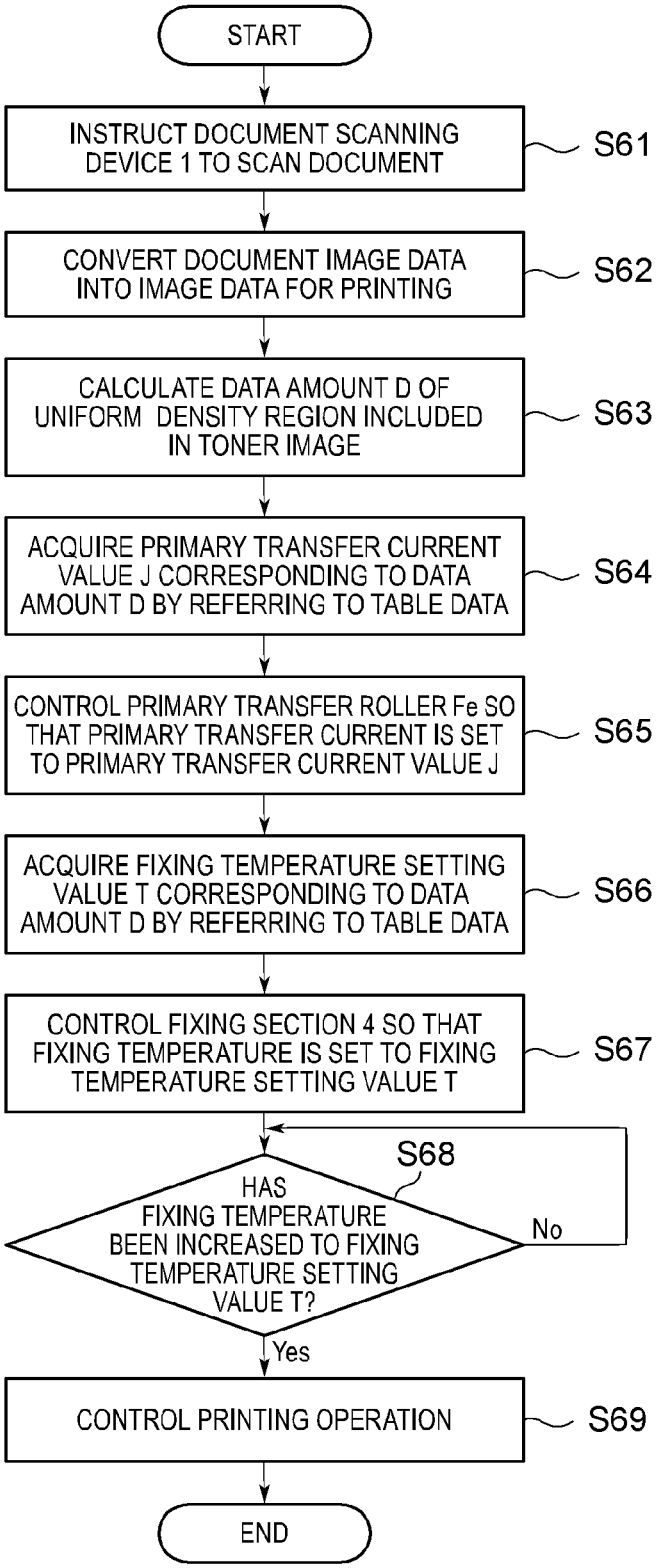
FIG. 12 is a flowchart illustrating a seventh process to be executed by the control section to implement the uneven brightness prevention function.

FIG. 12 is a flowchart illustrating the seventh process to be executed by the control section 60 to implement the uneven brightness prevention function. When sensing that the user has pressed the copy start key based on an operation signal input from the operation display section 62, the control section 60 starts the seventh process illustrated in FIG. 12. Also, hereinafter, the case in which the copy start key has been pressed after the user has set a document on the platen glass 11 is assumed.

Although not described above, the primary transfer roller Fe is disposed opposite the photoconductive drum Fa with the intermediate transfer belt 31 interposed therebetween and primarily transfers the toner image developed on the photoconductive drum Fa onto the intermediate transfer belt 31 by flowing a primary transfer current to the primary transfer roller Fe.

As illustrated in FIG. 12, when sensing that the user has pressed the copy start key, the control section 60 instructs the document scanning device 1 to scan the document set on the platen glass 11 (step S61). Thereby, the document scanning device 1 scans the document set on the platen glass 11, generates document image data of the RGB color space format representing an image of the scanned document, and outputs the generated document image data to the control section 60.

Subsequently, the control section 60 causes the image data memory 61 to store the document image data of the RGB color space format acquired from the document scanning device 1 as described above, converts the document image data into image data for printing of the CMYK color space format, and also causes the image data memory 61 to store the image data for the printing (step S62).

Subsequently, the control section 60 reads the image data for the printing from the image data memory 61, and calculates a data amount D of a uniform density region as a size parameter associated with a size of the uniform density region included in the toner image based on the read image data for the printing (step S63). Here, the control section 60 calculates the data amount D of the uniform density region for a toner image in which toner images of colors of CMYK are superimposed and integrally formed (a method of calculating the data amount D is similar to that of the third process).

Subsequently, the control section 60 acquires a primary transfer current value J corresponding to the data amount D of the uniform density region calculated in the above-described step S63 by referring to table data representing a preset correspondence relationship between the data amount D of the uniform density region and the primary transfer current value J as illustrated in FIG. 13B (step S64). As illustrated in FIG. 13B, when the data amount D of the uniform density region is larger in the above-described table data, the primary transfer current value J is also set to be larger. In addition, the primary transfer current value J is set to a value in which no uneven brightness occurs for the data amount D of the uniform density region.

Subsequently, the control section 60 controls the primary transfer roller Fe so that the primary transfer current value J of the primary transfer roller Fe is set to the primary transfer current value J acquired in the above-described step S64 (step S65).

Subsequently, the control section 60 acquires a fixing temperature setting value T corresponding to the data amount D of the uniform density region calculated in the above-described step S53 by referring to table data representing a preset correspondence relationship between the data amount D of the uniform density region and the fixing temperature setting value T as illustrated in FIG. 13A (step S66). As illustrated in FIG. 13A, when the data amount D of the uniform density region is larger in the above-described table data, the fixing temperature setting value T is also set to be larger. In addition, each fixing temperature setting value T is set to a value in which no uneven brightness occurs for the data amount D of the uniform density region.

Subsequently, the control section 60 controls the fixing section 4 so that the fixing temperature of the fixing section 4 is set to the fixing temperature setting value T acquired in the above-described step S66 (step S67).

Therefore, the control section 60 determines whether a fixing temperature from an output signal of the temperature sensor mounted on the heating roller 41 has been increased to the fixing temperature setting value T (step S68). In the case of "No," the control section 60 waits until the fixing temperature reaches the fixing temperature setting value T by iterating the process of step S68. On the other hand, in the case of "Yes," an image of a document scanned by the document scanning device 1 is printed on printing paper by controlling the toner image forming operation by the toner image forming section 3, the fixing operation by the fixing section 4, and the paper transport operation by the paper transport mechanism 5 based on image data for printing (step S69).

As described above, in the seventh process, the control section 60 calculates the data amount D of the uniform density region as a size parameter of the uniform density region included in the toner image, acquires the primary transfer current value J corresponding to the calculated data amount D of the uniform density region by referring to table data representing a preset correspondence relationship between the data amount D of the uniform density region and the primary transfer current value J, and controls the primary transfer roller Fe so that the primary transfer current value J of the primary transfer roller Fe is set to the acquired primary transfer current value J. Thereby, it is possible to properly and precisely set the primary transfer according to the data amount D of the uniform density region and consequently it is possible to obtain a high-quality image by suppressing the occurrence of uneven color.

In addition, in the seventh process, the control section 60 calculates the data amount D of the uniform density region as a size parameter of the uniform density region included in the toner image, acquires the fixing temperature setting value T corresponding to the calculated data amount D of the uniform density region by referring to table data representing a preset correspondence relationship between the data amount D of the uniform density region and the fixing temperature setting value T, and controls the fixing section 4 so that the fixing temperature of the fixing section 4 is set to the acquired fixing temperature setting value T. Thereby, it is possible to properly and precisely set the fixing temperature according to the data amount D of the uniform density region and consequently it is possible to obtain a high-quality image by suppressing the occurrence of uneven brightness.

Although the multifunction peripheral 100 in accordance with the embodiment of the present disclosure has been described above, the present disclosure is not limited to the above-described embodiment and modifications can be made freely within the scope of the present disclosure.

For example, because an optimum fixing temperature differs according to a thickness of printing paper in the first to third processes for implementing an uneven brightness prevention function described with reference to FIGS. 3 to 5, a function of switching an increase width of the fixing temperature according to the thickness of the printing paper to be used may be provided in the control section 60.

In addition, likewise, in the fourth to sixth processes for implementing the uneven brightness prevention function described with reference to FIGS. 6 to 11, a function of holding table data differing according to a thickness of printing paper and switching the table data to be referred to according to a thickness of printing paper to be used may be provided in the control section 60.

In addition, although a primary transfer current of the primary transfer roller Fe is controlled by calculating a data amount D of a uniform density region and referring to table data representing a preset correspondence relationship between the data amount D of the uniform density region and a primary transfer current value J in the seventh process of this embodiment, the present disclosure is not limited thereto. For example, in this embodiment, the primary transfer current of the primary transfer roller Fe may be controlled by calculating an area Q of a uniform density region and referring to table data representing a preset correspondence relationship between the area Q of the uniform density region and the primary transfer current value J. Also, in this embodiment, the primary transfer current of the primary transfer roller Fe may be controlled by calculating an area ratio QR of a uniform density region and referring to table data representing a preset correspondence relationship between the area ratio QR of the uniform density region and the primary transfer current value J. In addition, in this embodiment, after the area Q of the uniform density region, the area ratio QR of the uniform density region, or the data amount D of the uniform density region is calculated, the primary transfer current of the primary transfer roller Fe may be controlled when the area Q of the uniform density region, the area ratio QR of the uniform density region, or the data amount D of the uniform density region is greater than or equal to a threshold value.

In addition, in this embodiment, the fixing temperature of the fixing section 4 may be controlled by calculating two values of the area Q of the uniform density region, the area ratio QR of the uniform density region, and the data amount D of the uniform density region and referring to table data representing a correspondence relationship among the two calculated values of the area Q of the uniform density region, the area ratio QR of the uniform density region, and the data amount D of the uniform density region and a fixing temperature setting value T. In addition, in this embodiment, the primary transfer current of the primary transfer roller Fe may be controlled by calculating two values of the area Q of the uniform density region, the area ratio QR of the uniform density region, and the data amount D of the uniform density region and referring to table data representing a correspondence relationship between the two calculated values of the area Q of the uniform density region, the area ratio QR of the uniform density region, and the data amount D of the uniform density region and the primary transfer current value J.

In addition, although an example in which the image forming apparatus is the multifunction peripheral 100 has been described in the above-described embodiment of the present disclosure, the present disclosure can also be applied to other image forming apparatuses such as a printer, a copy machine, and a facsimile.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

a toner image forming section configured to form a toner image based on image data for printing on printing paper;

a fixing section configured to fix the toner image on the printing paper through thermocompression; and a control section configured to control a toner image forming operation by the toner image forming section and a fixing operation by the fixing section, wherein the control section calculates a size parameter associated with a size of a uniform density region included in the toner image based on the image data for the printing and controls a fixing temperature of the fixing section according to a calculation result.

2. The image forming apparatus according to claim 1, wherein the control section calculates an area of the uniform density region included in the toner image as the size parameter, and controls the fixing section so that the fixing temperature of the fixing section is higher than a normal set temperature when the calculated area of the uniform density region is greater than or equal to a threshold value.

3. The image forming apparatus according to claim 2, wherein the control section switches an increase width of the fixing temperature according to a thickness of the printing paper to be used.

4. The image forming apparatus according to claim 1, wherein the control section calculates an area ratio of the uniform density region to a total area of the toner image as the size parameter, and controls the fixing section so that the fixing temperature of the fixing section is higher than a normal set temperature when the calculated area ratio of the uniform density region is greater than or equal to a threshold value.

5. The image forming apparatus according to claim 1, wherein the control section calculates a data amount of the uniform density region included in the toner image as the size parameter, and controls the fixing section so that the fixing temperature of the fixing section is higher than a normal set temperature when the calculated data amount of the uniform density region is greater than or equal to a threshold value.

6. The image forming apparatus according to claim 1, wherein the toner image forming section includes color-specific image forming units configured to form toner images of colors necessary to form a color image; and wherein the control section calculates a data amount of a uniform density region included in each toner image formed by the image forming unit of each color as the size parameter, and controls the fixing section so that the fixing temperature of the fixing section is higher than a normal set temperature when a sum of color-specific data amounts is greater than or equal to a threshold value.

7. The image forming apparatus according to claim 1, wherein the control section calculates an area of the uniform density region included in the toner image as the size parameter, acquires a fixing temperature setting value corresponding to the calculated area of the uniform density region by referring to table data representing a preset correspondence relationship between the area of the uniform density region and the fixing temperature setting value, and controls the fixing section so that the fixing temperature of the fixing section is set to the acquired fixing temperature setting value.

8. The image forming apparatus according to claim 7, wherein the control section holds the table data that differs according to a thickness of the printing paper, and switches the table data to be referred to according to the thickness of the printing paper to be used.

9. The image forming apparatus according to claim 1, wherein the control section calculates an area ratio of the uniform density region to a total area of the toner image as the size parameter, acquires a fixing temperature setting value corresponding to the calculated area ratio of the uniform density region by referring to table data representing a preset correspondence relationship between the area ratio of the uniform density region and the fixing temperature setting value, and controls the fixing section so that the fixing temperature of the fixing section is set to the acquired fixing temperature setting value.

10. The image forming apparatus according to claim 1, wherein the control section calculates a data amount of the uniform density region included in the toner image as the size parameter, acquires a fixing temperature setting value corresponding to the calculated data amount of the uniform density region by referring to table data representing a preset correspondence relationship between the data amount of the uniform density region and the fixing temperature setting value, and controls the fixing section so that the fixing temperature of the fixing section is set to the acquired fixing temperature setting value.

11. The image forming apparatus according to claim 1, wherein the control section calculates at least two values of an area of the uniform density region included in the toner image, an area ratio of the uniform density region to a total area of the toner image, and a data amount of the uniform density region included in the toner image as the size parameter, acquires a fixing temperature setting value corresponding to a combination of the calculated values by referring to table data representing a correspondence relationship between the combination of the calculated values and the fixing temperature setting value, and controls the fixing section so that the fixing temperature of the fixing section is set to the acquired fixing temperature setting value.

12. The image forming apparatus according to claim 1, wherein the toner image forming section includes an intermediate transfer belt, an image forming unit configured to form the toner image and transfer the toner image onto the intermediate transfer belt through a primary transfer roller, and a secondary transfer roller configured to transfer the toner image transferred onto the intermediate transfer belt onto the printing paper, and wherein the control section controls the fixing temperature of the fixing section, calculates the size parameter associated with the size of the uniform density region included in the toner image based on the image data for the printing, and controls a primary transfer current to be used for a transfer by the primary transfer roller according to the calculation result.

* * * * *